United States Patent [19]

McConnell

[11] Patent Number: 4,839,989

[45] Date of Patent: Jun. 20, 1989

[54] DOOR LIGHT

[76] Inventor: Dale K. McConnell, 370 Howard Ave., Holland, Mich. 49424

[21] Appl. No.: 175,944

[22] Filed: Mar. 31, 1988

[51] Int. Cl.[4] ..... E06B 7/28

[52] U.S. Cl. ..... 49/171; 49/394

[58] Field of Search ..... 49/171, 394, 169

[56] References Cited

U.S. PATENT DOCUMENTS

| | | | |
|---|---|---|---|
| 1,670,948 | 5/1928 | Ackerman | 49/171 |
| 1,799,164 | 4/1931 | Griswold | 49/171 |
| 1,807,841 | 6/1931 | Hansen | 49/171 |
| 2,078,002 | 4/1937 | Keil et al. | 49/171 X |
| 2,624,922 | 1/1953 | Ackerman | 49/171 X |
| 3,203,052 | 8/1965 | Curtis, Jr. | 49/171 X |
| 4,021,967 | 5/1977 | Mulder et al. | 49/171 |
| 4,523,408 | 6/1985 | McConnell | 49/171 X |

*Primary Examiner*—Philip C. Kannan

*Attorney, Agent, or Firm*—Neil F. Markva

[57] ABSTRACT

A prefabricated door light unit comprises a rectangular ringlike frame units which project into the window opening from opposites thereof and are fixably mountable therein. The frame units define a window opening therethrough and have cooperating means for permitting the units to slidably telescope for accommodating the variable thickness of the door. The outer frame unit includes a tubular support wall structure integrally fixed to a peripheral flange wall and projecting substantially transversely therefrom into the door opening. The support wall structure includes a peripheral extension section extending away from a S-shaped cross section in a direction toward the inner frame unit. A window pane or door structure is hingedly connected to swing between open and closed positions with respect to the window opening adjacent one side of the peripheral extension section. A fastening mechanism secures the window pane or door in a closed position across the window opening with the peripheral extension section being disposed within the inner frame unit when the door light is mounted in the door opening. Particular features of the invention are directed to an outer covering structure and an indicia bearing section for display of a name or address number.

20 Claims, 4 Drawing Sheets

Fig. 7
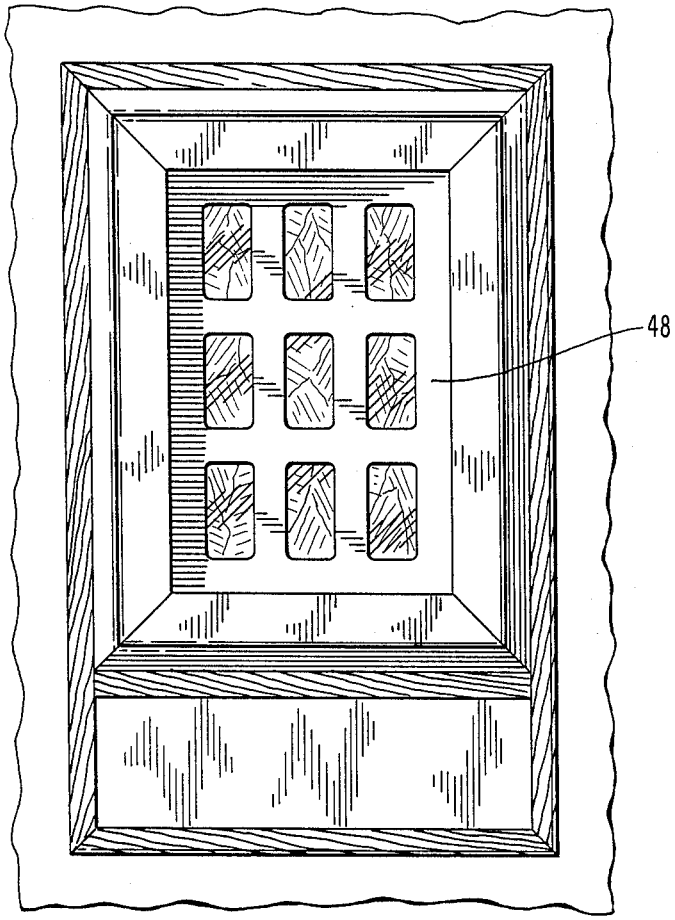
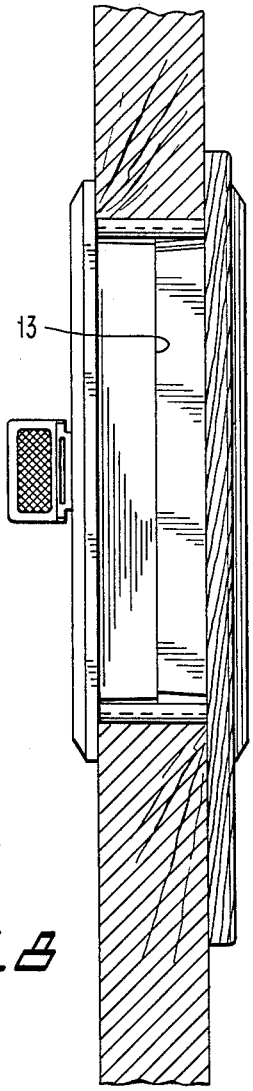
Fig. 8
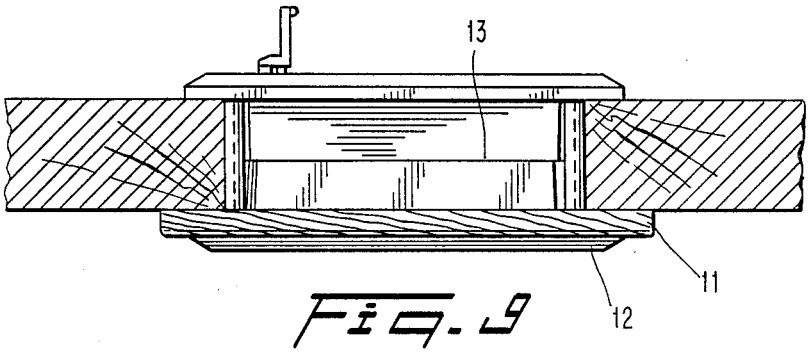
Fig. 9

DOOR LIGHT

FIELD OF THE INVENTION

This invention relates to a window structure for mounting in a door opening. More particularly, the invention relates to a door light usable in combination with a through-speaking device.

BACKGROUND OF INVENTION

The present invention constitutes an improvement of my earlier door light unit as set forth in U.S. Pat. No 4,523,408. My earlier door light structure was usable in connection with a sash unit with a window pane mechanism mounted in the outer portion of the outer frame member. This earlier structure is designed for window panes that are relatively large and allow for the relatively complex mechanism as disclosed therein.

Of particular interest is to provide a structure usable as a peephole device for doors. With such a structure, it is possible to view and/or talk to a person standing on the outside of a closed door. Such devices generally preclude a person on the outside to see into the room while the person on the inside is looking outwardly.

Prior art devices designed to provide a peephole capacity are generally relatively difficult to install and do not compensate for any variation in door thicknesses. Such prior art devices are generally disclosed in U.S. Pat. Nos. 1,686,942; 1,732,559; 1,747,156; 1,805,465; 2,489,060; 2,491,758; 2,057,239; 2,508,265; 2,624,922; and 2,638,810.

While some of these prior art structures include a speaking tube along with a viewing port, none of them provide such a functional combination forming an attractive door accessory while being easy to install on doors with varying thicknesses while providing the thermal resistance as a result of the use of molded plastics (polymers).

PURPOSE OF THE INVENTION

A primary purpose of this invention is to provide a door light structure having a molded polymer one-piece frame structure capable of supporting an outer skin covering.

Another purpose of the invention is to provide an attractive door light usable as a peephole device in combination with a through-speaking grill having a molded polymer inner core with an outer metallic skin structure.

A further object of the invention is to provide a peephole and speaking tube combination that is adjustable to various door thicknesses while maintaining a weather tight seal. That is, as the thickness of the door varies, the viewing door attached to the outer frame will maintain its relationship and will always maintain a seal.

A still further object is to provide a small viewing port with a swingaway door that can be installed in a residence entrance door.

SUMMARY OF THE INVENTION

The prefabricated door light unit of this invention comprises a rectangular ringlike frame means fixedly mountable within a door opening and defining a window opening therethrough. The frame means includes inner and outer frame units which project into the window opening from opposite sides thereof and means for fixedly connecting the inner and outer frame units together.

The inner and outer frame units have cooperating means for permitting the units to slideably telescope for accommodating the variable thickness from one door to the next. The outer frame unit comprises a one-piece, integral, ringlike rectangular frame having opposed and substantially parallel vertical side frame elements rigidly joined together by opposed and substantially parallel horizontal top and bottom frame elements.

The outer frame unit includes a tubular support wall structure integrally fixed to a peripheral flange wall and projecting substantially transversely from the flange wall into the door opening. The outer frame tubular support wall structure includes a peripheral extension section extending away from an S-shape cross section in a direction toward the inner frame unit. The S-shape cross section includes the peripheral flange wall, an intermediate wall and an substantially parallel inner wall. The peripheral extension section defines the window opening.

Hingedly connected window pane or door means swing between open and closed positions with respect to the window opening adjacent one-side of the peripheral extension section. Fastening means secure the window pane means in a closed position across the window opening. The peripheral extension section is disposed within the inner frame unit when the door light is mounted in the door opening.

In a specific embodiment, the door means is hingedly connected to and disposed within the peripheral extension section rearwardly of the inner parallel wall and speaking port grill means is disposed entirely within the S-shaped cross section forwardly of the inner parallel wall.

A particular feature of the invention is directed to a speaking port grill means including a rigid plate member having a plurality of openings to allow both audible speech to flow and a clear view therethrough. When the window pane means is closed, light comes through the window opening via the speaking port grill member. When the window pane or door means is open, the person on the inside has a clear view out through the window opening.

The window pane or door means includes a translucent pane member or an opaque slab having an outer peripheral edge section and a one-piece frame structure molded around the entire peripheral edge section. The frame structure includes hinge means, means for coupling the hinge means to one side of the peripheral extension section and fastening means for securing the window pane or door means in the closed position.

The hinge means comprises a living hinge connecting a hinge carrier section to the molded frame structure. The coupling means includes a plurality of tab members projecting outwardly from the hinge carrier section for grasping one side edge of the peripheral extension section.

The translucent pane member of the specific embodiment is slightly colored or tinted and has a roughened surface on one side thereof. Such a structure allows light to come through when the window pane means is closed but would not allow a clear view through the window opening.

The fastening means comprises latch means disposed on an opposing side of the frame structure from the hinge means and keeper means disposed on a side of the extension section opposite the latch means. The keeper means engages the latch means for securing the window pane means in the closed position across the window opening.

In a specific embodiment of the hinge means, a first plurality of tab members engage an outer surface of the extension section and a second plurality of tab members engage an inner surface of the peripheral extension section. Each of the outer and inner surfaces of the peripheral extension section includes channel means for receiving each respective tab member. The channel means on the outer surface of the peripheral extension section includes a slot for receiving a detent structure formed at the outer end of each tab member engaging the outer surface. The outer ends of each tab member engaging the inner surface of the peripheral section has an enlarged portion to produce tension within the tab members to increase the grasping strength of the coupling means.

In a specific embodiment of the fastening means, the latch means includes a projection upstanding from the frame structure and a living hinge connecting a latch handle to the molded frame structure. The latch handle includes spring latch means on one side thereof to engage the keeper means when the window pane means is in the closed position. The latch handle further includes means for engaging the upstanding projection on the side opposite the spring latch means to maintain the position of the latch handle within a delimited range of movement about the living hinge with respect to the frame sructure. The keeper means includes a bar portion covered by a metallic cap member which overlies the bar portion to engage the spring latch means when the window pane means is closed.

A particular feature of another embodiment of the invention is directed to the use of a metallic cap or covering to match a polished metallic surface on a speaker grill member. The frame units are one-piece, integrally molded member which sealingly fit into the door opening. The grill member may be made of molded plastic and be secured to the outside of the inner parallel wall. It is contemplated that the inner parallel may be continuous or discontinuous as desired. However, the use of a sealing membrane around the inside of the inner parallel wall enhances the insulation capacity of the unit when the window pane means is closed. The metallic cap or cover elements may be fitted over the outside surface of the vertical side frame elements and substantially parallel horizontal top and bottom frame elements. The metallic cover elements are secured between the inner peripheral wall and the rigid speaker grill member via using the same fastening screws extending through the wall into the grill members.

A further feature of the invention is the disposition of a frame structure having an indicia bearing section located thereon. Here the frame member accommodates the structure of the unit and is held in place by the door light when secured within the door opening. In a specific embodiment, the indicia bearing portion of the plate extends below the door light and may be used to carry the name of the resident or the appropriate resident's address number.

BRIEF DESCRIPTION OF DRAWINGS

Other objects of this invention will appear in the following description and appended claims, reference being made to the accompanying drawings forming a part of the specification wherein like reference characters designate corresponding parts in the several views.

FIG. 7 is a front elevational view of another embodiment of the door light made in accordance with the invention;

FIG. 8 is a side elevational view of the door light of FIG. 7; and

FIG. 9 is a top plan view of the door light of FIG. 7.

DETAILED DESCRIPTION

Figure 1:
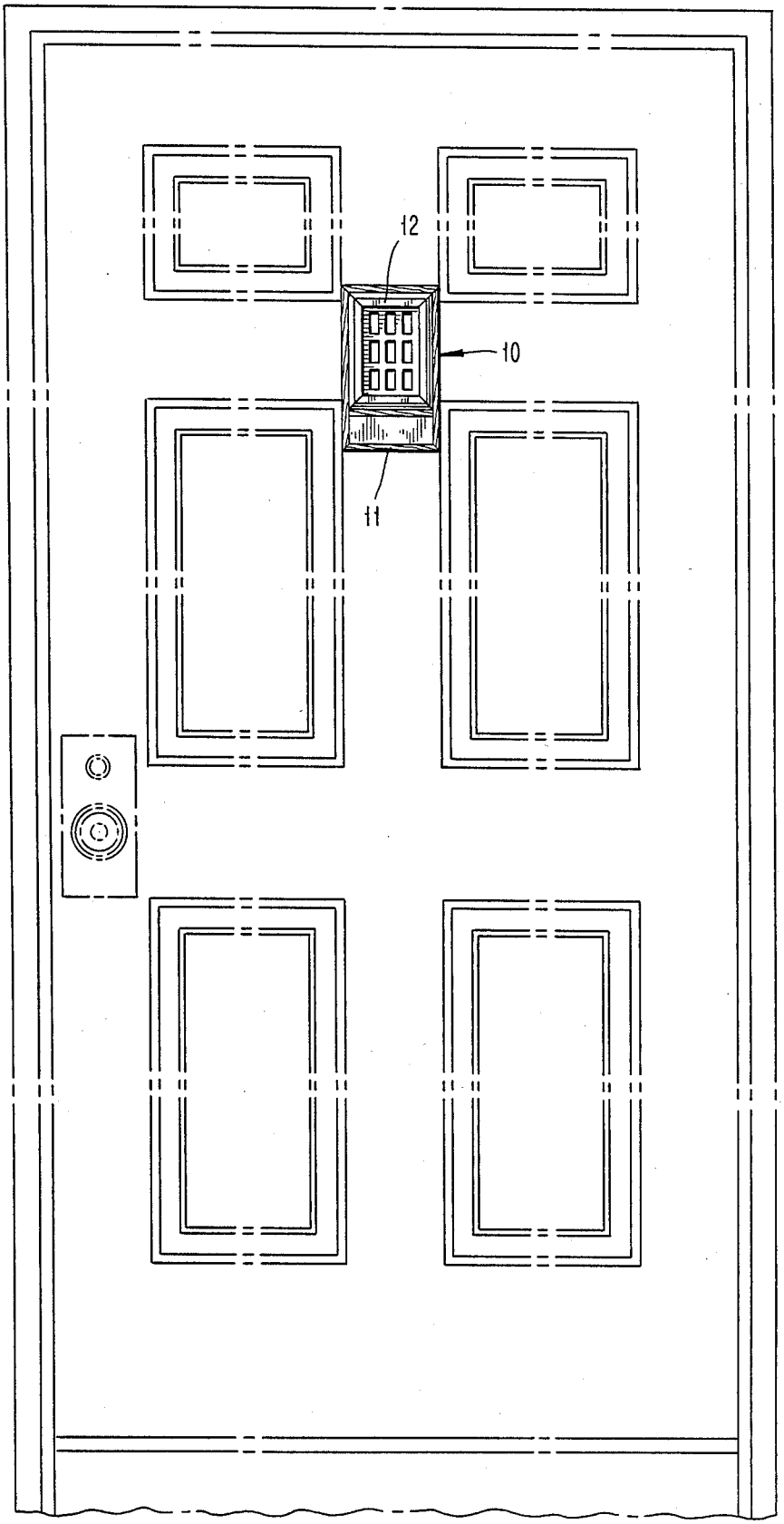
FIG. 1 is a front elevational view of a door light of the invention shown installed.
Figure 2:
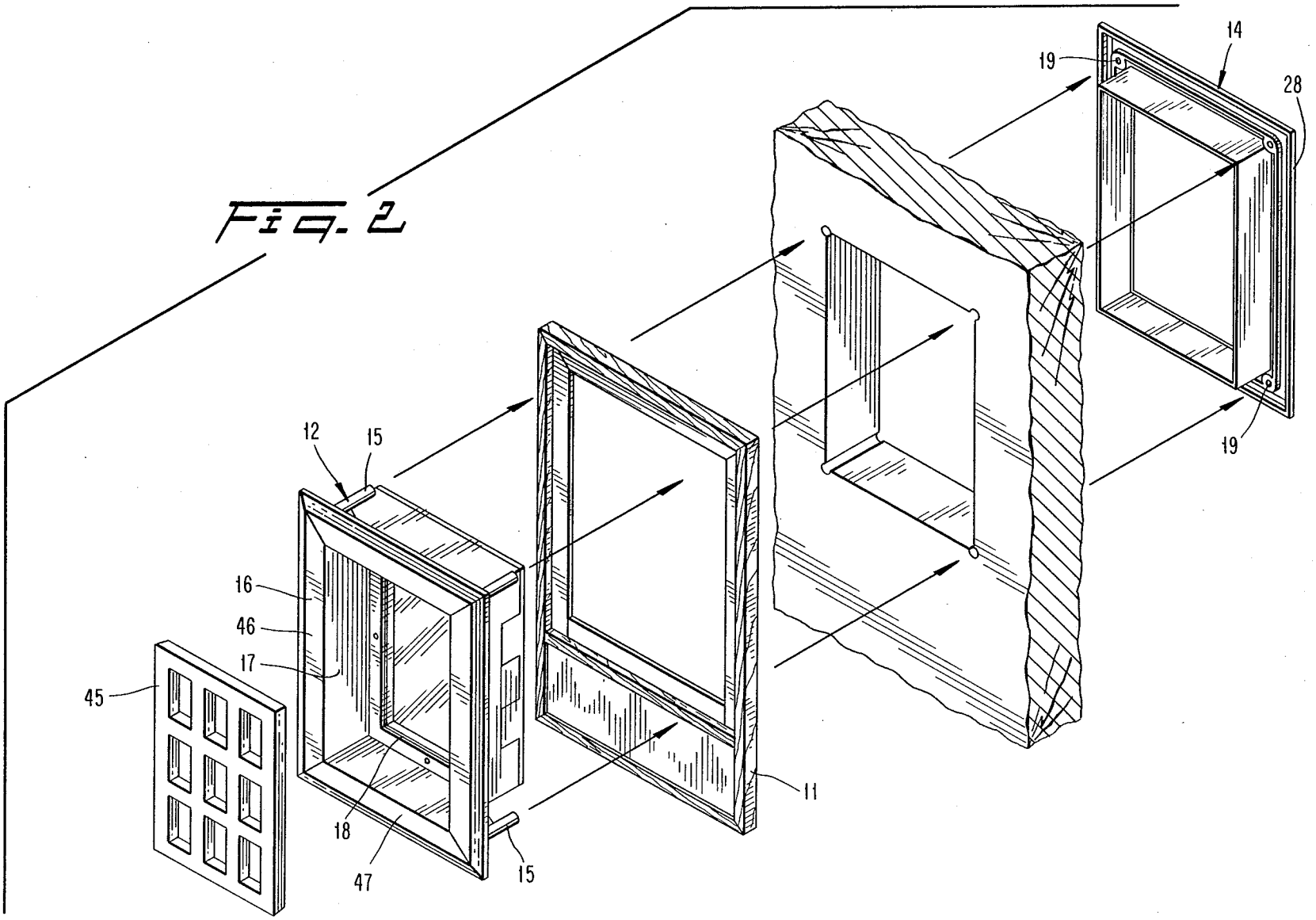
FIG. 2 is a perspective exploded view of a door light made in accordance with the invention.
Figure 3:
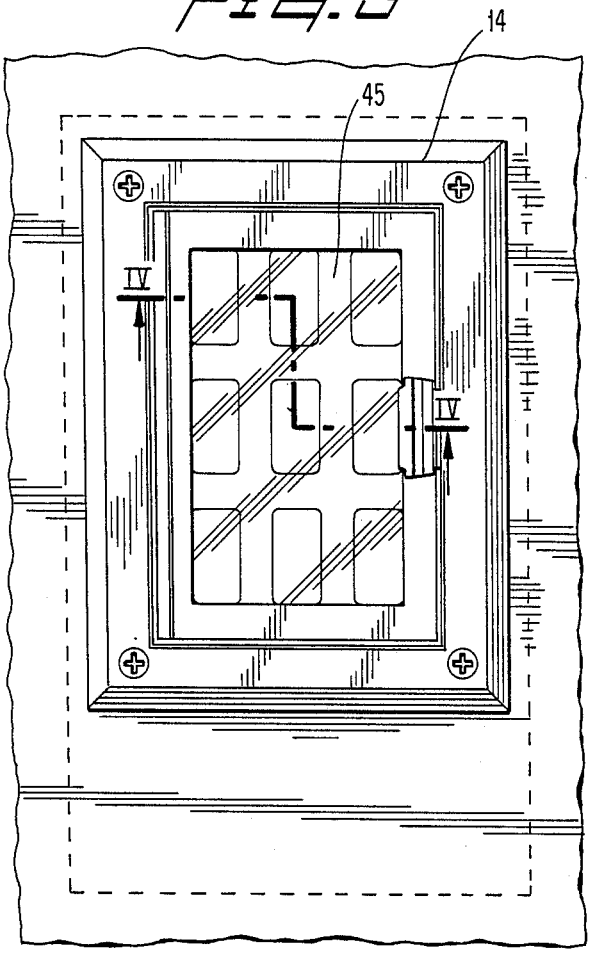
FIG. 3 is a rear elevational view showing the door light according to the invention.
Figure 6:
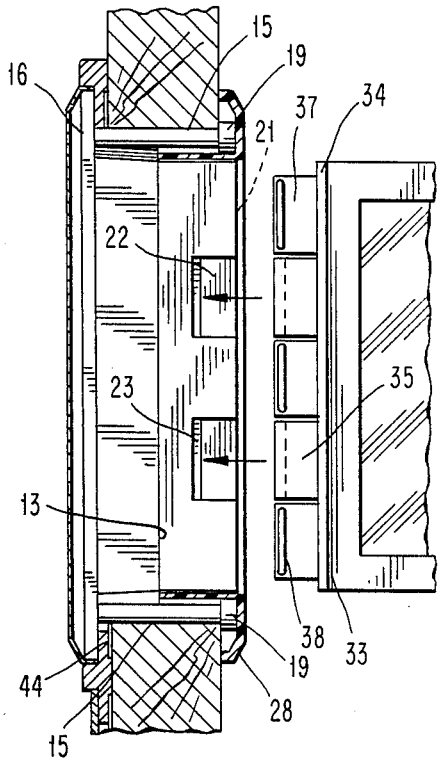
FIG. 6 is a fragmentary sectional view showing the hinge mechanism to be assembled.
Figure 4:
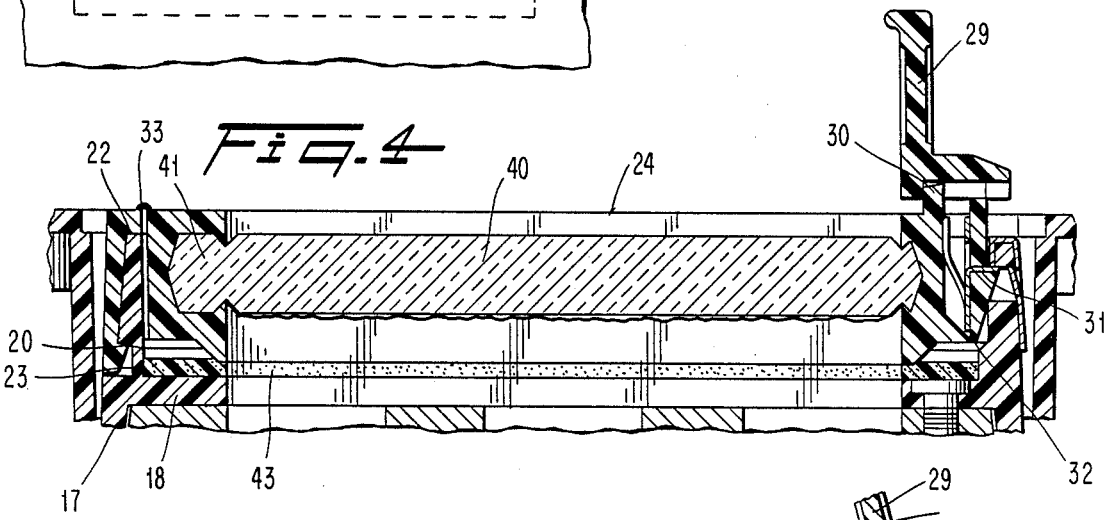
FIG. 4 is a sectional view along line IV–IV of FIG. 3 showing the hinge and fastening mechanisms with the door light of the invention in a closed position.
Figure 5:
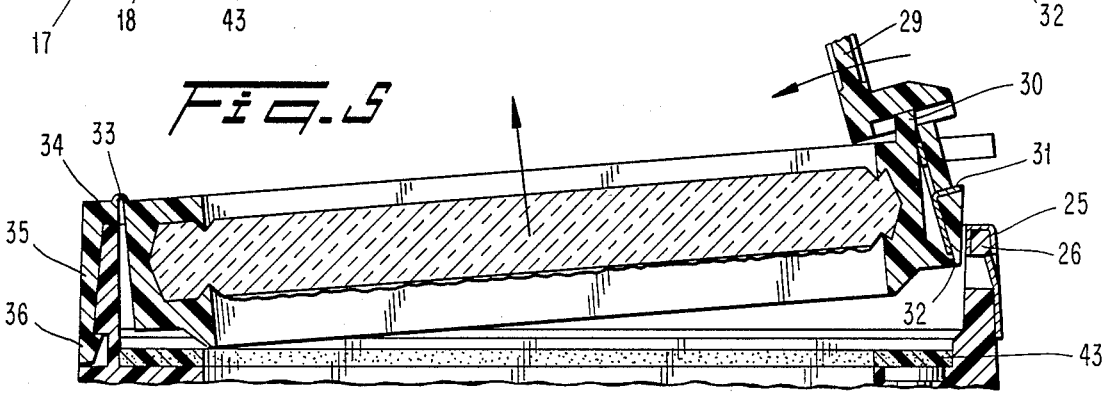
FIG. 5 is the sectional view of FIG. 4 showing the door light in an open position.

As described herein, the door light, generally designated 10, may be mounted in any conventional type door as in my earlier U.S. Pat. No. 4,523,408. In today's door market, whether wood or steel, two designs generally constitute approximately 80% of the market; namely, the six panel rail and style design and the flush design. The six panel door is the most popular and has been produced for years by wood door manufacturers using wood to produce the rails, styles and panels. The steel door manufacturers simulate the same look by embossing a single panel of steel. The flush door design is the second most popular door in both industries and includes a flat surface or has plaques or plantons added for decoration.

Door light 10 of this embodiment has outside dimensions of about 4½ by about 641 and fits the center rail of most standard six panel doors. It is also usable on the flush design as well as many other available door styles.

Door light 10 includes an outer frame unit 12 which telescopes into an inner frame unit 14. Outer frame unit 12 has a peripheral wall flange 16 that engages the outer surface of the door as shown. Inner frame unit 14 has a peripheral wall flange 28 engaging the inner surface of a door when door light 10 is installed within a door opening. The peripheral shoulder 13 on outer frame unit 12 limits the inward movement of inner frame unit 14 with respect to outer frame unit 12. Internal fastening bosses 15 register with fastener bosses 19 when respective frame units 12 and 14 are telescoped together. Screws (not shown) are placed through openings on the inner peripheral wall flange 28 and tighten door light 10 within the door opening in a known manner.

Outer frame unit 12 includes an intermediate wall 17 extending inwardly from peripheral wall flange 16 to an inner flange 18 forming an inner wall that is substantially parallel to the peripheral wall flange 16. Peripheral wall flange 16, intermediate wall 17 and inner parallel wall 18 form an S-shaped cross section in frame unit 12. Inner parallel wall 18 is a continuous flange in this embodiment but might also be discontinuous. Its structure shold be effective to support the elements secured thereto and provide a base for the sealing member 43.

Peripheral extension section 20 extends away from the inner parallel wall 18 in a direction toward the inner frame unit 14. Channel means 21 and 22 located along one edge of the extension section 20 on the respective inside and outside surfaces thereof are designed to receive tab members 35 and 37 as described below. Angular slots 23 formed at the outer end of channel means 22 receive detents 36 of tab members 35.

A translucent pane member 40 has a molded door frame structure 24 disposed around an entire outer edge section 41. Translucent pane member 40 allows light to shine through while precluding a clear viewing through the door light opening. Frame structure 24 includes a hinge mechanism on one side thereof and a latching mechanism disposed on a side opposite from the hinge mechanism. The location of any hinge mechanism with respect to the fastening mechanism may vary depending on the particular design of the door light of this invention.

The hinge mechanism includes a living hinge 33 connecting a living hinge carrier 34 along one side of door frame structure 24. A plurality of tab members 35 and 37 project outwardly from the living hinge carrier 34. Outer tab members 35 fit into outer channel means 22 while inner tab members 37 are disposed within inner channel means 21. Tab members 35 include a detent 36 shaped to snap fit into slots 23 of channel means 22. Enlarged portions 38 at the end of inner tab members 37 cause the molded plastic material of the tab members 35 and 37 to be forced apart thereby enhancing their grasping strength inwardly with respect to the edge of peripheral extension section 20.

Although adhesive material may be used to effect the desired connection, with the hinge connection as disclosed herein, no additional adhesive or mechanical means is necessary to secure the hinge mechanism to the peripheral extension section 20.

A fastener mechanism disposed on the side of the frame structure 24 opposite the hinge mechanism includes a living hinge 32 which connects a latch handle 29 to the frame structure. A latch snap projection 30 is disposed at an edge of the frame structure 24. As latch handle 29 pivots about living hinge 32, the edge of handle 29 snaps over projection 30 which allows handle 29 to move a delimited amount about hinge 32.

Catch member 31 projects outwardly from handle 29 toward the keeper mechanism disposed on the edge of peripheral extension section 20. Keeper element 25 composed of metal in this particular embodiment is bent about a keeper bar 26 comprising a portion of extension section 20. Keeper bar 26 defines a keeper opening into which catch member 31 projects and secures the window pane structure in a closed position. Movement of handle 29 toward the snap projection 30 releases catch member 31 and allows the door to be open when desired.

Sealing member or gasket 43 disposed along the inside of inner wall 18 seals around the window opening when the window pane structure is in the closed condition. An outer gasket 44 disposed between the peripheral wall flange 16 and the outer surface of the door provides a weather seal.

An indicia carrier frame member 11 is disposed around the peripheral wall flange 16 and carry a name or address number plate as shown in FIG. 8. In this embodiment frame member 11 is a separate element held in place by peripheral wall flange 16 when frame units 12 and 14 are tightened in place within the door opening.

Speaker grill member 45 is made of a piece of metal such as brass and has a polished outside surface. Speaker grill member 45 is a rigid plate secured to the outside of inner wall member 18. When using a metallic grill member, metallic cap elements 46 and 47 are fitted over the outside surface formed by vertical side frame elements rigidly joined together by opposed and substantially parallel horizontal top and bottom frame elements. Cover elements 46 and 47 attach to inner wall 18 by the same fastening members which connect rigid speaker grill member 45 thereto. When using a colored plastic material speaker grill member 48 has the molded configuration as shown in FIG. 8.

While the door light has been shown and described in detail, it is obvious that this invention is not to be considered as limited to the exact form disclosed, and that changes in detail and construction may be made therein within the scope of the invention without departing from the spirit thereof.

Having thus set forth and disclosed the nature of this invention, what is claimed is:

1. A prefabricated door light unit for use in an opening formed in a door, said door light unit comprising:

(a) ringlike frame means adapted to be fixedly mounted in said door opening and defining therein a window opening;

(b) door means mounted on said frame means for covering said window opening;

(c) said frame means including inner and outer ringlike frame units which mount in said door opening from respective inner and outer sides of the door opening;

(d) said inner and outer frame units having a slidable telescopic connection therebetween when mounted within said door opening;

(e) said outer frame unit comprising an integral, one-piece, ringlike, performed outer frame having a ringlike peripheral flange wall adapted for engagement with the outer surface of the door in surrounding relationship to the door opening;

(f) said outer frame also including a tubular support wall structure integrally fixed to said peripheral flange wall and projecting substantially transversely therefrom into said door opening;

(g) said outer frame tubular wall structure defining an outer peripheral support surface thereon and defining said window opening therein;

(h) said outer frame having a substantially S-shaped cross section including inner and outer approximately parallel walls which are integral with and project in opposite directions from the opposite ends of an intermediate wall;

(i) said outer wall defining said peripheral flange wall and said intermediate wall defining said tubular support wall structure;

(j) said intermediate wall defining said outer support surface on the outer periphery thereof with said latter surface extending substantially perpendicular to a vertical plane of the door opening;

(k) said intermediate wall defining thereon an inner peripheral surface which, at least along the bottom of said outer frame, slopes downwardly as it projects from the inner wall to said outer wall to permit drainage of water therefrom exteriorly of the door;

(l) said inner frame unit comprising a rectangular ringlike frame having a peripheral flange wall which is positionable adjacent and engageable with the inner surface of the door in surrounding relationship to the door opening;

(m) said inner frame unit also defining transverse suppour walls which are fixed to and project transversely from said peripheral flange wall into said door opening;

(n) said transverse walls of the inner frame unit defining thereon an inner support surface whereby said transverse walls project into said door opening into the region between the edge of said door opening and said tubular wall structure so that the inner and outer frame units can be slidably moved toward one another until the respective peripheral flange walls thereof respectively engage the inner and outer faces of the door;

(o) said frame means including fastener means extending between said inner and outer frame units for fixedly connecting same together;

(p) said outer frame tubular support wall structure including a peripheral extension section extending away from said S-shaped cross section in a direction toward the inner frame unit;

(q) said peripheral extension section of the outer frame tubular support wall structure defining said window opening;

(r) said door means being hingedly connected to swing between open and closed positions with respect to said window opening adjacent one side of the peripheral extension section; and (s) fastening means for securing the door means in a closed position across said window opening;

(t) said peripheral extension section being disposed within the interior frame when the door light unit is mounted in said door opening.

2. A door light unit as defined in claim 1 wherein sealing means is disposed within the peripheral extension section between the inner parallel wall of the outer frame unit and the hingedly connected door means.

3. A door light unit as defined in claim 1 wherein speaking port grill means is secured to said inner parallel wall of the outer frame.

4. A door light unit as defined in claim 3 wherein the speaking port grill means includes a rigid plate member having a plurality of openings extending therethrough to allow audible speech to flow therethrough.

5. A door light unit as defined in claim 4 wherein the outer frame means includes an outer finished cover means defined by at least one cover element secured to the outer frame unit.

6. A door light unit as defined in claim 5 wherein the cover means includes a plurality of cover elements each secured to the inner parallel wall with the rigid plate member disposed over a portion of each cover element and secured to said inner parallel wall.

7. A door light unit as defined in claim 1 wherein said door means includes a translucent pane member having an outer peripheral edge section and a one-piece frame structure molded around the entire outer peripheral edge section, said frame structure includes hinge means, means for coupling said hinge means to said one side of the peripheral extension section and latch means disposed on an opposing side of the frame structure from the hinge means, keeper means is disposed on a side of said peripheral extension section opposite said one side thereof to engage said latch means for securing the door means in said closed position across the window opening, whereby the combination of said latch means and said keeper means define said fastening means.

8. A door light unit as defined in claim 7 wherein said latch means includes a projection upstanding from said frame structure and a living hinge connecting a latch handle to said molded frame structure, said latch handle includes spring latch means on one side thereof to engage the keeper means when the door means is in said closed position, said latch handle further includes means for engaging the upstanding projection on the side opposite said one side thereof to maintain the position of the latch handle within a delimited range of movement about said living hinge with respect to said frame structure.

9. A door light unit as defined in claim 1 wherein said door means includes a translucent pane member having an outer peripheral edge section and a one-piece frame structure molded around the entire outer peripheral edge section, said frame structure includes hinge means and means for coupling said hinge means to said one side of the peripheral extension section.

10. A door light unit as defined in claim 9 wherein said hinge means comprises a living hinge connecting a hinge carrier section to the molded window pane frame structure, and said coupling means includes a plurality of tab members projecting outwardly from the hinge carrier section for grasping said one side of the peripheral extension section.

11. A door light unit as defined in claim 10 wherein a first plurality of tab members engage an outer surface of the peripheral extension section and a second plurality of tab members engage an inner surface of the peripheral edge section, each of said outer and inner surfaces of the peripheral extension section includes channel means for receiving each respective tab member.

12. A door light unit as defined in claim 11 wherein the channel means on the outer surface of the peripheral extension section includes a slot for receiving a detent structure formed at the outer end of each tab member engaging said outer surface.

13. A door light unit as defined in claim 12 wherein the outer ends of each tab member engaging the inner surface of the peripheral extension section has an enlarged portion to produce tension within the tab members to increase the grasping strength of the coupling means.

14. A prefabricated door light unit for use in an opening formed in a door, said door light unit comprising:

(a) rectangular ringlike frame means fixedly mountable within the door unit and defining a window opening therethrough;

(b) said frame means including inner and outer frame units which project into the window opening from opposite sides thereof and means for fixedly connecting said inner and outer frame units together;

(c) said inner and outer frame units having cooperating means for permitting said units to slidably telescope for accommodating the variable thickness of the door;

(d) said outer frame unit comprising a one-piece, integral, ringlike, rectangular frame having opposed and substantially parallel vertical side frame elements rigidly joined together by opposed and substantially parallel horizontal top and bottom frame elements;

(e) said outer frame unit including a tubular support wall structure integrally fixed to a peripheral flange wall and projecting substantially transversely therefrom into said door opening;

(f) said outer frame tubular support wall structure including an S-shaped cross section and a peripheral extension section extending away from said S-shaped cross section in a direction toward the inner frame unit;

(g) said peripheral extension section of the outer frame tubular support wall structure defining said window opening;

(h) window pane means hingedly connected to swing between open and closed positions with respect to said window opening adjacent one side of the peripheral extension section; and (i) fastening means for securing the window pane means in a closed position across said window opening;

(j) said peripheral extension section being disposed within the inner frame unit when the door light is mounted in said door opening.

15. A door light unit as defined in claim 14 wherein said window pane means is hingedly connected to and disposed within said peripheral extension section rearwardly of said S-shaped cross section including an inner parallel wall and speaking port grill means is disposed entirely within the tubular support wall structure of said S-shaped cross section forwardly of said inner parallel wall.

16. A door light unit as defined in claim 15 wherein the speaking port grill means includes a rigid plate member having a plurality of openings extending therethrough to allow audible speech to flow therethrough.

17. A door light unit as defined in claim 14 wherein said window pane means includes a translucent pane member having an outer peripheral edge section and a one-piece frame structure molded around the entire said peripheral edge section, said frame structure includes hinge means and means for coupling said hinge means to said one side of the peripheral extension section.

18. A door light unit as defined in claim 17 wherein said hinge means comprises a living hinge connecting a hinge carrier section to the molded window pane frame structure, and said coupling means includes a plurality of tab members projecting outwardly from the hinge carrier section for grasping said one side of the peripheral extension section.

19. A door light unit as defined in claim 14 wherein the outer frame means includes an outer finished cover means defined by at least one cover element secured to the outer frame unit.

20. A door light unit as defined in claim 14 wherein said frame means includes indicia bearing means projecting from a frame unit along the outer surface of the door.

* * * * *